US007438505B2

(12) United States Patent
Olsen et al.

(10) Patent No.: US 7,438,505 B2
(45) Date of Patent: Oct. 21, 2008

(54) HEAVE COMPENSATED SNUBBING SYSTEM AND METHOD

(75) Inventors: Bernt Olsen, Elk City, OK (US); Randall D. Lagendyk, Houma, LA (US); Bertrom Ballard, Jr., Tomball, TX (US); Gary Vaughan, Katy, TX (US); Hiram L. Bickle, Magnolia, TX (US); Bjorn Rudshaug, Kristiansand (NO)

(73) Assignee: Cudd Pressure Control, Inc., Houston, TX (US)

( * ) Notice: Subject to any disclaimer, the term of this patent is extended or adjusted under 35 U.S.C. 154(b) by 193 days.

(21) Appl. No.: 11/174,200

(22) Filed: Jul. 1, 2005

(65) Prior Publication Data

US 2006/0078390 A1 Apr. 13, 2006

Related U.S. Application Data

(60) Provisional application No. 60/584,899, filed on Jul. 1, 2004.

(51) Int. Cl.
*E21B 41/04* (2006.01)

(52) U.S. Cl. ..... 405/224.4; 166/355; 166/359

(58) Field of Classification Search ..... 166/350, 166/355, 359

See application file for complete search history.

(56) References Cited

U.S. PATENT DOCUMENTS

| | | | | |
|---|---|---|---|---|
| 4,733,991 | A * | 3/1988 | Myers | 405/224.2 |
| 4,787,778 | A * | 11/1988 | Myers et al. | 405/224.4 |
| 4,883,387 | A * | 11/1989 | Myers et al. | 405/224.4 |
| 5,479,990 | A * | 1/1996 | Peppel | 166/350 |
| 6,814,140 | B2 | 11/2004 | Robichaux | 166/77.4 |
| 2005/0123358 | A1 | 6/2005 | Blackseth et al. | 405/224.2 |

OTHER PUBLICATIONS

International Search Report for PCT/US2005/023531, dated Apr. 24, 2006.

* cited by examiner

*Primary Examiner*—Tara L. Mayo
(74) *Attorney, Agent, or Firm*—Micahel Barnhart; Henry L. Ehrlich; Winstead PC

(57) ABSTRACT

A heave compensation system to enable the transfer of tubulars between a floating platform and a snubbing jack. The heave compensation system includes a first end connected to the floating platform and a second end in connection with a traveling slip assembly of the snubbing jack, the heave compensation system is operable between a disengaged position and an engaged position. When the heave compensation system is in the disengaged position the traveling slip assembly moves separate and independent from the movement of the floating platform, and when the heave compensation system is in the engaged position the traveling slip assembly is locked in a constant position relative to the floating platform.

39 Claims, 3 Drawing Sheets

HEAVE COMPENSATED SNUBBING SYSTEM AND METHOD

RELATED APPLICATIONS

This application claims the benefit of U.S. Provisional Patent Application No. 60/584,899 filed Jul. 1, 2004, incorporated in its entirety herein by reference.

FIELD OF THE INVENTION

The present invention relates in general to drilling operations and more specifically to subsea wellbore operations performed from a floating platform.

BACKGROUND

Wells are often drilled in water environments wherein the well is accessed from a floating platform such as a drilling ship or a floating rig such as semi-submersible rigs. Theses floating platforms move up and down as a result of wave motion. The heaving of the floating platform makes it difficult to conduct wellbore operations and often requires that the operations cease. It is especially difficult to transfer pipe to and from snubbing units for conducting snubbing operations when the platform heaves.

Therefore, it is a desire to provide a heave compensation system that facilitates transfer of tubulars between a floating platform and a snubbing unit. It is a still further desire to provide a heave compensation system that facilitates the utilization of the floating platforms pipe handling equipment for the makeup and breakout of the pipe strings. It is a still further desire to provide a heave compensation system that eliminates the need to provide a separate subsea frame to support the snubbing unit.

SUMMARY OF THE INVENTION

In the prior art snubbing operations it is difficult to transfer tubulars from the platforms pipe handling system to the snubbing jack due to the heave of the platform. Often the heaving significantly reduces the time windows available to perform snubbing operations.

Accordingly, a heave compensation system to enable the transfer of tubulars between a floating platform and a snubbing jack is provided. A heave compensation system of the present invention includes an elongated member having a first end connected to the floating platform and a second end in connection with a traveling slip assembly of the snubbing jack, the heave compensation system operable between a disengaged position and an engaged position. When the heave compensation system is in the disengaged position the traveling slip assembly moves separate and independent from the movement of the floating platform, and when the heave compensation system is in the engaged position the traveling slip assembly is locked in a constant position relative to the floating platform.

The floating platform may be, but is not limited to, a drilling vessel or a semi-submersible rig. The platform preferably includes pipe handling equipment and systems. The present invention facilitates the transfer of tubulars between the platform and the snubbing jack and allows the makeup and breakout of the tubulars with the platforms pipe handling equipment while the tubulars and held by the snubbing jack.

When the heave compensation system is in the engaged position, the traveling slip assembly is held in a substantially constant position relative to the platform as the floating platform heaves. The snubbing jack's cylinder may be freed to allow it to extend or contract in response to the movement of the platform and the traveling slip assembly. The snubbing jack's cylinder may be actively operated to match the movement of the traveling slip assembly in response to movement of the platform.

In an embodiment of the heave compensation system, the heave compensation system remains in physical connection with the traveling slip assembly when the heave compensation system is disengaged. In the disengaged position the traveling block is permitted to be moved by the snubbing jack relative to the stationary slips, separate and independent from the movement of the floating platform. In another embodiment of the heave compensation system, the heave compensation system may be physically disconnected from the traveling slip assembly when in the disengaged position.

The heave compensation system may include a piston having a first end connected to the platform and a second end. A lock slip assembly may be connected to the second end of the piston. Wherein the lock slip assembly is connected to the traveling slip assembly by entrapping the lock slip assembly between the frame of the traveling slip assembly and the top end of a hydraulic piston or linear motor.

The heave compensation system of the present invention may further include supporting the snubbing jack by a riser tensioning system. This configuration facilitates operating the system without traditional support frames utilized in prior snubbing systems.

A method of utilizing the heave compensation system of the present invention for snubbing operations includes the steps of positioning a floating platform above a subsea wellbore, connecting a snubbing jack having a traveling slip assembly carrying traveling slips, stationary slips, and a moveable cylinder for moving the traveling slip assembly with respect to the stationary slips to the subsea wellbore, engaging a heave compensation system locking the traveling slip assembly in a substantially constant position relative to the platform, transferring a tubular between the floating platform and the traveling slip assembly, and disengaging the heave compensation system permitting the traveling slip assembly to move separate and independent of the floating platform.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
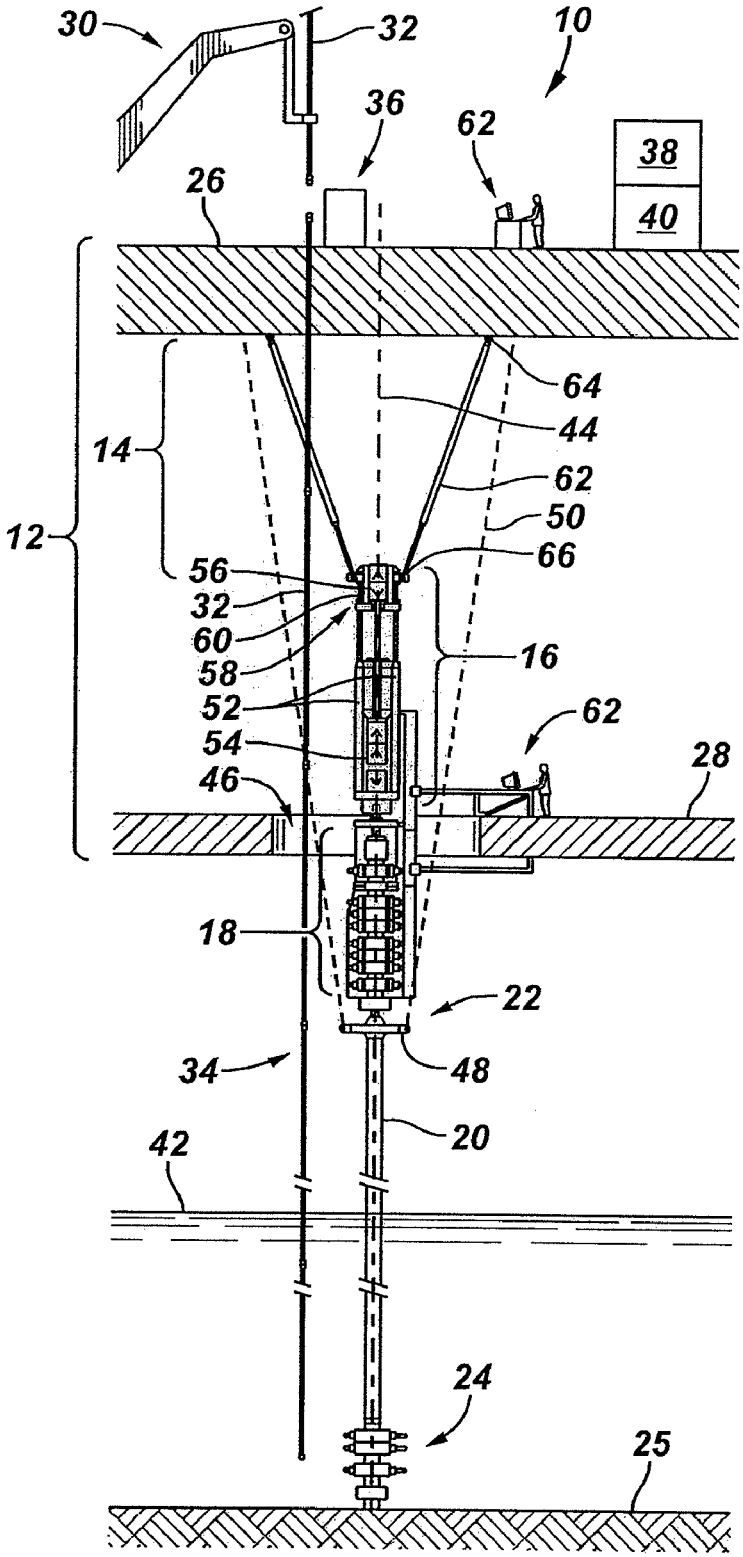
FIG. 1 is a perspective view of an embodiment of the heave compensated snubbing system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a perspective view of an embodiment of a heave compensated snubbing system, generally referred to by the numeral 10, of the present invention. System 10 includes a floating platform 12, a compensation system 14, a snubbing jack 16, a blowout preventer (BOP) stack 18, a riser 20, a riser tensioning system 22, and a wellhead 24.

Floating platform 12 may be any platform, vessel, or structure adapted for conducting well drilling and/or well workover operations. For purposes of explanation, floating platform 12 is an partial illustration of a semi-submersible drilling facility for purposes of explanation. Floating platform 12 may include a drilling floor 26 and a lower deck 28. Platform 12 includes draw works 30 for handling joints of tubulars 32 that makeup the workstring 34. Tubulars 32 may include single joints or stands of pipe. For purposes of illustration, workstring 34 is shown removed from the wellbore and system. Platform 12 further includes pipe handling devices and systems, generally denoted by the numeral 36, including, but not limited to, pipe tongs, elevator bails, doping apparatus, stabbing apparatus, spinning apparatus, and torque apparatus. Pipe handling system 36 also includes draw works 30. Platform 12 further including power sources such as hydraulic and/or pneumatic systems 38 and electrical systems 40.

Platform 12 is positioned on a body of water over a subsea wellbore having a wellhead 24 proximate the subsea floor 25. Decks 26, 28 are positioned above surface 42 of the body of water. Desirably, the longitudinal axis 44 of wellhead 24 is positioned substantially vertically through the moon pool 46 of platform 12. However, it should be recognized that platform 12 may deviate from being perpendicularly aligned over wellhead 24 due to factors such as, but not limited to, wellhead 24 configuration on subsea floor 25, currents and drift. Platform 12 tends to move, or heave, in relation to the subsea floor 25 in response to wave action and tidal changes of surface 42.

Riser 20 is a conduit connected to wellhead 24 and extends the wellbore above water level surface 42. Riser tensioning system 22 includes a tension ring 48 and tethers 50 for maintaining riser 20 in tension. Tension ring 48 is connected to riser 20. Tethers 50 are connected between platform 12 and tension ring 48.

BOP stack 18, the surface pressure control system, is connected to riser 20 above and proximate to tensioning ring 48. Snubbing jack 16 is connected atop BOP stack 18. In a desired configuration, jack 16 is positioned below drill floor 26 even when traveling slip assembly 58 is fully extended. It should be noted that system 10 of the present invention does not require subsea frames as required in prior art systems. Riser tensioning system 22 supports the weight of riser 20, and maintains the top of riser 20 and tensioning ring 48 in a substantially constant position relative to subsea floor 25.

Traveling slip 58 may extend a distance sufficient to maintain traveling slip assembly 58 in a substantially constant position relative to platform 12. Thus, operation range of system 10 is only determined by sea surface conditions that move platform 12 relative to stationary slips 54.

Hydraulic snubbing jack 16 includes hydraulic cylinders 52, lower or stationary slips 54, and upper or traveling slips 56. Snubbing jack 16 may further include a rotary table, stripper and other mechanisms not shown in detail. Traveling slips 56 and any built-in rotary table are contained in the traveling slip assembly 58 connected to the top ends 60 of cylinders 52. Snubbing jack 16 is hydraulically operated and desirably connected to hydraulic system 38 of platform 12. Operation of cylinders 52 move traveling slip assembly 58 in relation to stationary slips 54. The stroke length of jack 16, cylinders 52, may vary based on the requirements for the particular application. Operation of jack 16, including the movement of traveling slip assembly 58 and the opening and closing of slips 54, 56, is via a control panel 62. Control panel 62 is desirably located at drill floor 26 in the driller's cabin. Control panel 62 also provides controls for draw works 30 and pipe handing systems 36. Panel 62 or redundant panels 62 may be positioned at other locations such as lower deck 28.

Snubbing jack 12 is illustrated as a four-legged reciprocating hydraulic snubbing jack. Other embodiments may include, but are not limited to, one-legged, two-legged, and semi-continuous reciprocating jack assemblies.

Snubbing is a generic term known in the art that covers the processes involved in running tubular goods (coiled tubing and jointed pipe) into or out of a wellbore while there is a surface pressure or the possibility thereof.

Stripping is the movement of tubular goods when the pipe weight exceeds the pressure exerted on the tubulars. In other works, the workstring must be restrained from falling into the wellbore. Snubbing is the movement of tubulars when the pressure exerted on them is greater than their buoyed weight. In other words, snubbing requires that the workstring be restrained from coming out of the wellbore. The term snubbing includes both stripping and snubbing.

Compensation system 14 is selectively connectable, or engageable, between platform 12 and traveling slip assembly 58. Compensation system 14 includes one or more pistons 62 having a first end 64 and a second end 66. First end 64 is connected to platform 12. Second end 66 is connectable to traveling slip assembly 58. When compensation system 14 is engaged, traveling slip assembly 58 is locked into a position constant with platform 12 whereby workstring 34 temporarily follows the movement of platform 12 for making up and breaking out tubulars 32. This further allows the utilization of pipe handling system 36 of platform 12 without having to provide duplicate systems for the snubbing operations. In the disengaged position, traveling slip assembly is not locked in a constant position relative to platform 12.

Desirably, compensation pistons are hydraulically operated to permit spacing of second end 66 relative to platform 12 and traveling slip assembly 58. Additionally, it is desired that the hydraulics of snubbing jack 16 are simultaneously connected to compensation system 14.

Figure 2:
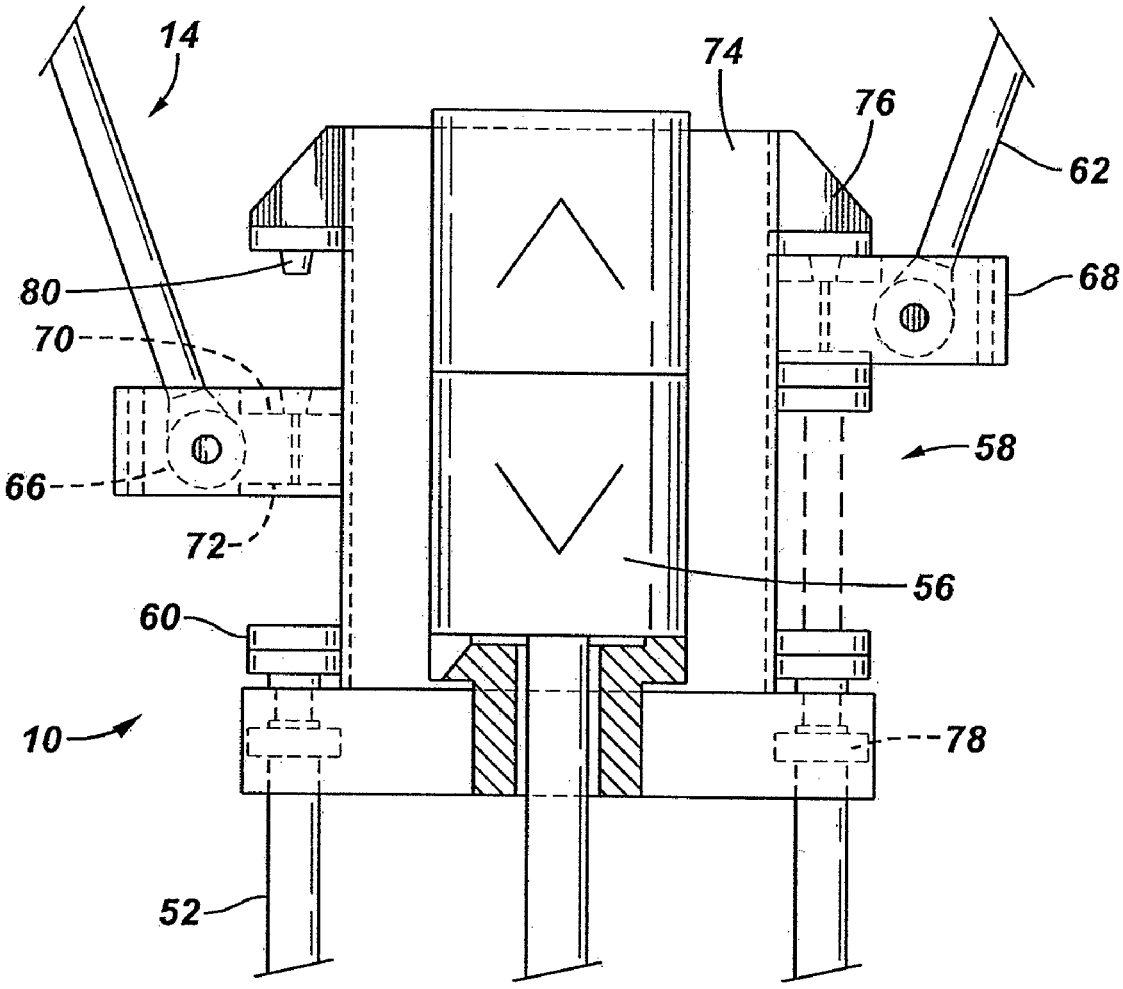
FIG. 2 is an exploded view of an embodiment of the connection between the traveling slip assembly and the compensation system.
Figure 3:
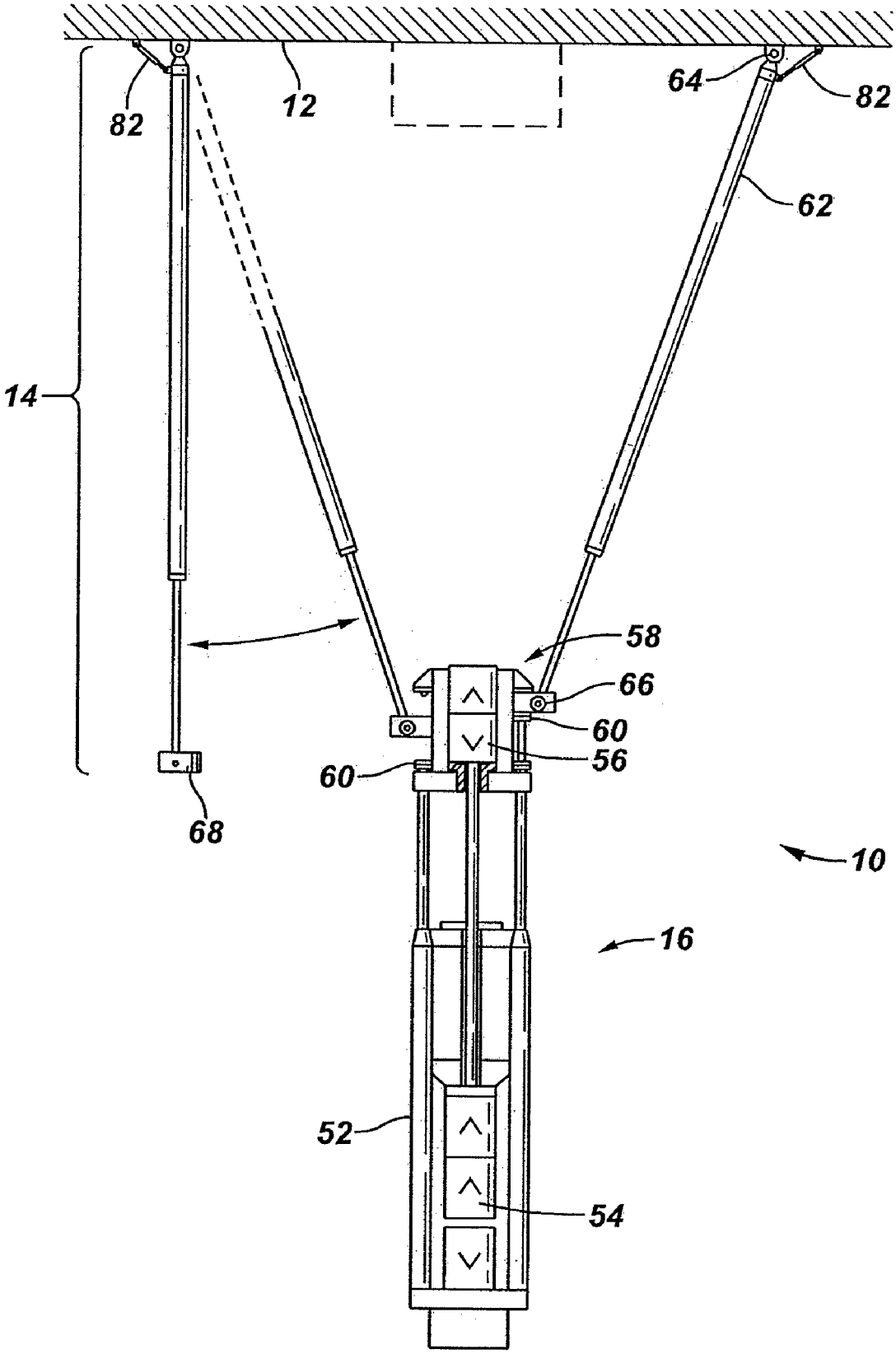
FIG. 3 is an expanded view of an embodiment of the compensation system illustrated in FIG. 2.

Second end 66 of piston 62 may be fixedly connected to traveling slip assembly 58, or removably connected to traveling slip assembly 58 in a manner such as illustrated in FIGS. 2 and 3. In a fixed connection embodiment, when compensation system 14 is disengaged, pistons 62 are free to extend or contract in response to the movement of platform 12 relative to traveling slip assembly 58.

FIG. 2 is an exploded view of an embodiment of the connection between traveling slip assembly 58 and compensation system 14. The left side of FIG. 2 illustrates piston 62 in a disengaged position and the right side illustrates piston 62 in an engaged position.

Compensation system 14 includes a lock slip assembly 68 connected to second end 66. Lock head 68 includes a first recess 70 and a second recess 72. Traveling slip assembly 58 includes a frame 74 having a stop 76 and a flange 78. Top end 60 of cylinder 52 is positioned between stop 76 and flange 78. First recess 70 is adapted to receive stop 76 and second recess 72 is adapted to receive top end 60 of cylinder 52. Stop 76 may further include a projection 80 for further engaging lock head 68.

With reference to the left side of FIG. 2, compensation system 14 is disengaged. In the disengaged position, cylinder 52 is retracted such that tope end 60 of cylinder 52 is positioned proximate flange 78 so that head 68 is moveable relative to traveling slip assembly 58. Top end 60 may utilize an ACME thread connection with flange 78. In this position, head 68 is disconnected from stop 76 and top end 60 permitting separate and independent movement of traveling slip assembly 58 and compensation system 14.

With reference to the right side of FIG. 2, compensation system 14 is engaged. In the engaged position, cylinder 52 is extended entrapping head 68 between stop 76 and second end 60 of cylinder 52.

FIG. 3 is an expanded view of an embodiment of compensation system 14 as illustrated in FIG. 2. The left side of FIG. 3 illustrates compensation system 14 being disengaged from traveling slip assembly 58. Compensation system 14 is shown engaged, locking traveling slip assembly 58 in a position relative to platform 12, in the right side of FIG. 3.

Compensation system 14 may further include a tilt cylinder 82 connected between platform 12 and piston 62. As shown on the left side of FIG. 3, when lock head 68 is disengaged from traveling slip assembly 58, tilt cylinder 82 may be actuated to move piston 62 and head 68 away from traveling slip assembly 58. When compensation system 14 is in the engaged position, the right side of FIG. 3, tilt cylinder 82 has actuated lock head 68 to a position between stop 76 and top end 60.

A method of snubbing is now described with reference to FIGS. 1 through 3. Floating platform 12 is positioned above wellhead 24 such that moon pool 46 is substantially vertically aligned above the longitudinal axis of wellhead 24. Riser 20 is connected to wellhead 24 and extends above water surface 42. Tensioning system 22 is connected between platform 12 and riser 20 and set in tension, relative to the mean seal level 42. A desired BOP stack 18 is connected to riser 20 proximate riser tensioning ring 48. Hydraulic jack 16 is connected atop BOP stack 18. Heave compensation system 14 is in connection with platform 12. Compensation system 14, jack 16, and pipe handing systems 36 are operationally connected such as to be substantially simultaneously operated.

For running a workstring 34 into a wellbore, workstring 34 is engaged by traveling slips 56 placing workstring 34 and traveling slip assembly 58 in a constant position relative to one another. A tubular 32 (single joint or stand) is picked up by pipe handing system 36 of platform 12. Heave compensation system 14 is engaged locking traveling slip assembly 58 in a constant position relative to platform 12. Jack cylinders 52 are released or actuated prior to, or simultaneous with, the activation of compensation system 14 allowing traveling slip assembly 58 to follow the movement of platform 12. Tubular 32 is positioned proximate to workstring 34 via pipe handling system 35 and draw works 30. Tubular 32 may then be made up with workstring 34 utilizing pipe handling system 36. A rotary table, either passive or powered, in traveling slip assembly 58 may be locked to prevent rotation of workstring 34 during makeup or break out. Heave compensation system 14 is then disengaged, releasing traveling slip assembly 58 from its substantially constant position relative to platform 12. Tubular 32 is then snubbed into wellhead 24. Heave compensation system 14 may then be engaged to transfer another tubular 32 from platform 12 to snubbing jack 16. For removing pipe from wellhead 24 the processes is reversed, engaging heave compensation system 14 to transfer tubulars 32 from jack 16 to platform 12, and disengaging heave compensation system 14 to snub pipe from wellhead 24.

Those skilled in the art will appreciate that pipe handling system 36 may need to be modified from that typically used on a given platform 12. For example, if engagement of compensation system 14 leaves traveling slip assembly 58 an unacceptable distance below or above drill floor 26, tubing tongs may need to be relocated relative to drill floor 26. The tubing tongs may be relocated to false drill floor, traveling slips assembly 58, or other device or structure.

In another embodiment of the present invention, pipe 32 (single joint or stand) is picked up by pipe handling system 36 and workstring 34 is engaged by stationary slips 54. heave compensation system 14 is engaged locking traveling slip assembly 58, and not locking workstring 34, in a substantially constant position relative to platform 12. Pipe 32 is lowered into slips 56 of traveling slip assembly 58, and pipe 32 is engaged by slips 56. Compensation system 14 is disengaged and pipe 32 is brought into proximity to workstring 34 by traveling slip assembly 58. Pipe handling system 36 can then be used to make up pipe 32 with workstring 34. Stationary slips 54 may be locked, or otherwise prevented from rotating, to allow make up or break out of pipe 32 from workstring 34. Alternatively, a spider or similar device, not shown, may be built into snubbing jack 16 to prevent rotation of workstring 34 during make up or break out.

From the foregoing detailed description of specific embodiments of the invention, it should be apparent that a heave compensated snubbing system and method for inserting or removing tubulars from a subsea wellbore that is novel and unobvious has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including, but not limited to, those implementation variations which may have been suggested herein, may be made to the disclosed embodiments without departing from the spirit and scope of the invention as defined by the appended claims which follow.

What is claimed is:

1. A heave compensation system to enable the transfer of tubulars between a floating platform and a snubbing jack, the system comprising:

a piston having a first end connected to the floating platform and a second end in connection with a traveling slip assembly of the snubbing jack, the piston operable between a disengaged position and an engaged position, wherein when the piston is in the disengaged position the second end is disconnected from physical connection with the traveling slip assembly and the traveling slip assembly moves separate and independent from the movement of the floating platform and when the piston is in the engaged position the traveling slip assembly is locked in a constant position relative to the floating platform; and a tilt cylinder in connection with the piston and the platform, wherein the tilt cylinder moves the second end of the piston between a position for connecting the piston to the traveling slip assembly and a position spaced apart from the traveling slip assembly when the piston is in the disengaged position.

2. The system of claim 1, wherein the piston is hydraulically operated.

3. The system of claim 1, further including a lock head connected to the second end of the piston, wherein the lock head is connected to the traveling slip assembly when the piston is in the engaged position and wherein the lock head is disconnected from the traveling slip assembly when the piston is in the disengaged position.

4. A heave compensation system to enable the transfer of tubulars between a floating platform and a snubbing jack, the system comprising:

a piston having a first end connected to the floating platform and a second end in connection with a traveling slip assembly of the snubbing jack, the piston operable between a disengaged position and an engaged position;

a lock head connected to the second end of the piston, the lock head having a first recess and an opposing second recess;

a stop connected to the traveling slip assembly; and the snubbing jack including a hydraulic cylinder having a top end wherein when the piston is in the disengaged position the traveling slip assembly moves separate and independent from the movement of the floating platform; and when the piston is in the engaged position the stop is positioned in the first recess, the top end of the cylinder is positioned in the second recess of the lock head locking the piston with the traveling slip assembly and the traveling slip assembly is locked in a constant position relative to the floating platform.

5. The system of claim 4, further including a tilt cylinder in connection with the piston and the platform; wherein the tilt cylinder moves the lock head of the piston between a position for connecting the piston to the traveling slip assembly and a position spaced apart from the traveling slip assembly when the piston is in the disengaged position.

6. A heave compensated snubbing system for transferring tubulars between a floating platform and a snubbing jack, the system comprising:

a riser connected to a sub sea wellhead;

a hydraulic snubbing jack in connection with the riser and wellhead, the snubbing jack having stationary slips, a traveling slip assembly carrying traveling slips, and a hydraulic cylinder for moving the traveling slip assembly with respect to the stationary slips;

a floating platform positioned substantially vertically above the subsea wellhead; and a heave compensation system in connection between the platform and the traveling slip assembly when transferring tubulars between the platform and the snubbing jack; wherein the heave compensation system is operable between an engaged position locking the traveling slip assembly in a substantially constant position relative to the platform and a disengaged position wherein the traveling slip assembly and platform are moveable independent and separate from one another.

7. The system of claim 6, further including a blowout preventer connected between the riser and the snubbing jack.

8. The system of claim 7, further including a riser tensioning system connected between the riser and the platform.

9. The system of claim 6, further including a riser tensioning system connected between the riser and the platform.

10. The system of claim 9, wherein the snubbing jack is supported by the riser tensioning system.

11. The system of claim 6, wherein the snubbing jack is supported by the riser.

12. The system of claim 11, further including a riser tensioning system connected between the riser and the platform.

13. The system of claim 6, wherein the heave compensation system is hydraulically operated.

14. The system of claim 6, wherein the heave compensation system comprises a piston having a first end connected to the platform and a second end that remains in physical connection with the traveling slip assembly when the heave compensation system is in the disengaged position.

15. The system of claim 6, wherein the heave compensation system is disconnected from physical connection with the traveling slip assembly when the piston is in the disengaged position.

16. The system of claim 6, wherein the heave compensation system comprises:

a piston having a first end connected to the platform and a second end; and a lock head connected to the second end of the piston, wherein the lock head is connected to the traveling slip assembly when the heave compensation system is in the engaged position and wherein the lock head is disconnected from the traveling slip assembly when the heave compensation system is in the disengaged position.

17. The system of claim 16, further including a tilt cylinder in connection with the piston and the platform; wherein the tilt cylinder moves the lock head of the piston between a position for connecting the piston to the traveling slip assembly and a position spaced apart from the traveling slip assembly when the heave compensation system is in the disengaged position.

18. The system of claim 16, further including a riser tensioning system connected between the riser and the platform.

19. The system of claim 18, wherein the snubbing jack is supported by the riser tensioning system.

20. The system of claim 18, wherein the snubbing jack is supported by the riser tensioning system.

21. The system of claim 16, wherein the snubbing jack is supported by the riser.

22. The system of claim 6, further including:

a stop connected to the traveling slip assembly; and wherein the heave compensation system comprises:

a piston having a first end connected to the platform and a second end; and a lock head connected to the second end, the lock head having a first recess and an opposing second recess:

wherein when the heave compensation system is in the engaged position the stop is positioned in the first recess and a top end of the snubbing jack cylinder is positioned in the second recess of the lock head, locking the piston with the traveling slip assembly.

23. The system of claim 22, further including a tilt cylinder in connection with the piston and the platform wherein the tilt cylinder moves the lock head of the piston between a position for connecting the piston to the traveling slip assembly and a position spaced apart from the traveling slip assembly when the heave compensation system is in the disengaged position.

24. The system of claim 22, wherein the snubbing jack is supported by the riser.

25. A heave compensated snubbing system for transferring tubulars between a floating platform and a snubbing jack, the system comprising:

a riser connected to a subsea wellhead;

a floating platform positioned substantially vertically above the subsea wellhead;

a riser tensioning system having a tensioning ring connected to the riser and a tether in connection between the tension ring and the platform;

a snubbing jack in connection with the riser and wellhead, the snubbing jack having stationary slips, a traveling slip assembly carrying traveling slips, and a hydraulic cylinder for moving the traveling slip assembly with respect to the stationary slips, the hydraulic cylinder having a top end;

a heave compensation system including a piston having a first end connected to the platform and a second end connected to the traveling slip assembly when transferring tubulars between the platform and the snubbing jack; wherein the heave compensation system is operable between an engaged position locking the traveling slip assembly in a substantially constant position relative to the platform and a disengaged position wherein the traveling slip assembly and platform are moveable independent and separate from one another.

26. The system of claim 25, further including a blowout preventer connected to the riser between the riser tensioning ring and the snubbing jack.

27. The system of claim 26, further including:

a lock head connected to the second end of the piston, the lock head having a first recess and an opposing second recess; and a stop connected to the traveling slip assembly; wherein when the piston is in the engaged position the stop is positioned in the first recess and the top end of the cylinder is positioned in the second recess of the lock head locking the piston with the traveling slip assembly.

28. The system of claim 27, further including a tilt cylinder in connection with the piston and the platform; wherein the tilt cylinder moves the lock head of the piston between a position for connecting the piston to the traveling slip assembly and a position spaced apart from the traveling slip assembly when the heave compensation system is in the disengaged position.

29. The system of claim 28, wherein the system does not include a frame positioned between the snubbing jack and the seabed floor for supporting the snubbing jack.

30. The system of claim 25, further including:

a lock head connected to the second end of the piston, the lock head having a first recess and an opposing second recess; and a stop connected to the traveling slip assembly; wherein when the piston is in the engaged position the stop is positioned in the first recess and the top end of the cylinder is positioned in the second recess of the lock head locking the piston with the traveling slip assembly.

31. The system of claim 25, further including a tilt cylinder in connection with the piston and the platform; wherein the tilt cylinder moves the lock head of the piston between a position for connecting the piston to the traveling slip assembly and a position spaced apart from the traveling slip assembly when the heave compensation system is in the disengaged position.

32. The system of claim 25, wherein the system does not include a frame positioned between the snubbing jack and the seabed floor for supporting the snubbing jack.

33. A method for transferring tubulars from a floating platform to a snubbing jack for conducting snubbing operations in a subsea wellbore, the method comprising the steps of:

positioning a floating platform above a subsea wellbore;

connecting a snubbing jack to the subsea wellbore, the snubbing jack having a traveling slip assembly carrying traveling slips, stationary slips, and a moveable cylinder for moving the traveling slip assembly with respect to the stationary slips;

engaging a heave compensation system locking the traveling slip assembly in a substantially constant position relative to the platform;

transferring a tubular between the floating platform and the traveling slip assembly; and disengaging the heave compensation system permitting the traveling slip assembly to move separate and independent of the floating platform.

34. The method of claim 33, further including the step off conducting snubbing operations when the heave compensation system is disengaged.

35. The method of claim 33, wherein the heave compensation system comprises a piston having a first end connected to the platform and a second end connected to the traveling slip assembly when transferring tubulars between the platform and the snubbing jack.

36. The method of claim 35, wherein:

the engaging step comprises:

locking the piston at a substantially constant length; and moving the cylinder in response to the movement of the floating platform and the traveling slip assembly; and the disengaging step comprises unlocking the piston permitting the traveling slip assembly to move separate and independent of the movement of the floating platform.

37. The method of claim 35, wherein:

the engaging step comprises:

locking the piston at a substantially constant length; and permitting the cylinder to move in response to the movement of the floating platform and the traveling slip assembly; and the disengaging step comprises unlocking the piston permitting the traveling slip assembly to move separate and independent of the movement of the floating platform.

38. The method of claim 35, wherein:

the engaging step comprises:

locking the piston at a substantially constant length; and moving the cylinder in response to the movement of the floating platform and the traveling slip assembly; and the disengaging step comprises releasing the piston from physical contact with the traveling slip assembly.

39. The method of claim 35, wherein:

the engaging step comprises:

locking the piston at a substantially constant length; and permitting the cylinder to move in response to the movement of the floating platform and the traveling slip assembly; and the disengaging step comprises releasing the piston from physical contact with the traveling slip assembly.

* * * * *